US009139405B2

(12) United States Patent
Balcom

(10) Patent No.: US 9,139,405 B2
(45) Date of Patent: Sep. 22, 2015

(54) FORK-MOUNTED FORK TRUCK BOOM APPARATUS

(71) Applicant: David E. Balcom, Wyoming, MI (US)

(72) Inventor: David E. Balcom, Wyoming, MI (US)

( * ) Notice: Subject to any disclaimer, the term of this patent is extended or adjusted under 35 U.S.C. 154(b) by 339 days.

(21) Appl. No.: 13/751,913

(22) Filed: Jan. 28, 2013

(65) Prior Publication Data

US 2013/0284541 A1 Oct. 31, 2013

Related U.S. Application Data

(60) Provisional application No. 61/640,124, filed on Apr. 30, 2012.

(51) Int. Cl.

| | |
|---|---|
| ***B66C 23/44*** | (2006.01) |
| ***B66F 9/12*** | (2006.01) |
| ***B66F 9/06*** | (2006.01) |

(52) U.S. Cl.

CPC . *B66F 9/12* (2013.01); *B66C 23/44* (2013.01); *B66F 9/061* (2013.01); *Y10T 29/49826* (2015.01)

(58) Field of Classification Search

CPC ..... B66C 23/44; B66F 9/061
USPC ..... 212/180
See application file for complete search history.

(56) References Cited

U.S. PATENT DOCUMENTS

| | | | | |
|---|---|---|---|---|
| 68,217 A | | 8/1867 | Lewis | |
| 95,573 A | | 10/1869 | Dodge | |
| 1,460,082 A | | 6/1923 | Spahr | |
| 2,386,759 A | | 10/1945 | Ulm | |
| 2,820,561 A | * | 1/1958 | Meagher | 414/607 |
| 2,832,489 A | | 4/1958 | Bailey | |
| 2,941,683 A | | 6/1960 | Fowler | |
| 2,944,689 A | | 7/1960 | Arnot | |
| 2,990,074 A | | 6/1961 | Berquist et al. | |
| 3,007,592 A | | 11/1961 | Adams | |
| 3,207,347 A | | 9/1965 | Ehrlich | |
| 3,229,830 A | | 1/1966 | Smith | |
| 3,396,862 A | | 8/1968 | Fischer | |
| 3,410,432 A | | 11/1968 | Foss et al. | |
| 3,415,339 A | | 12/1968 | Range | |
| 3,534,990 A | | 10/1970 | Didtel et al. | |
| 3,587,893 A | | 6/1971 | Laken | |
| 3,674,161 A | | 7/1972 | Grinde | |
| 3,759,399 A | | 9/1973 | Glass et al. | |

(Continued)

FOREIGN PATENT DOCUMENTS

| | | |
|---|---|---|
| JP | 54-039873 | 3/1979 |
| JP | 02-175598 A | 7/1990 |
| KR | 10-2009-0076041 | 7/2009 |

*Primary Examiner* — James Keenan
(74) *Attorney, Agent, or Firm* — Price Heneveld LLP

(57) ABSTRACT

A boom accessory for a fork truck comprises a frame having receiver tubes for receiving forks of a fork truck, a boom extending forwardly from the frame, and a frame-to-carriage anchor assembly on the frame. The frame-to-carriage anchor assembly includes a carriage-attaching subassembly with top and bottom connectors for securely engaging mating structure on the fork truck's carriage, and includes a vertically-slidable anchor between the carriage-attaching subassembly and the frame to restrain the frame horizontally from sliding forwardly off the forks. By this arrangement, the forks can lift a weight of the frame, boom, and boom-carried load without stressing the anchor assembly, but can provide a substantial and secure horizontal retaining force prevent the boom accessory from sliding forward off the forks.

8 Claims, 7 Drawing Sheets

(56) References Cited

U.S. PATENT DOCUMENTS

| | | | | | |
|---|---|---|---|---|---|
| 3,773,200 | A | * | 11/1973 | Morris | 414/607 |
| 3,788,492 | A | | 1/1974 | Kraft | |
| 3,851,777 | A | | 12/1974 | Dilny | |
| 4,065,013 | A | | 12/1977 | Orthman | |
| 4,102,464 | A | | 7/1978 | Schuster | |
| 4,159,059 | A | * | 6/1979 | Christenson et al. | 414/724 |
| 4,230,434 | A | | 10/1980 | Seaberg | |
| 4,426,188 | A | | 1/1984 | Wolf et al. | |
| 4,488,832 | A | | 12/1984 | Kinshofer | |
| 4,568,217 | A | | 2/1986 | Forsman et al. | |
| 4,579,504 | A | * | 4/1986 | Lemme et al. | 414/607 |
| 4,666,360 | A | * | 5/1987 | Harms et al. | 414/607 |
| 4,699,565 | A | | 10/1987 | Seaberg | |
| 4,850,789 | A | | 7/1989 | Zimmerman | |
| 5,033,934 | A | | 7/1991 | Emilio | |
| 5,145,034 | A | | 9/1992 | Miles | |
| 5,244,336 | A | | 9/1993 | Engler et al. | |
| 5,975,831 | A | | 11/1999 | Martin | |
| 6,233,827 | B1 | | 5/2001 | Oliver et al. | |
| 8,454,295 | B2 | * | 6/2013 | Balcom | 414/607 |
| 2004/0197178 | A1 | | 10/2004 | Osterloh et al. | |
| 2007/0183882 | A1 | | 8/2007 | Salazar | |
| 2008/0101907 | A1 | | 5/2008 | Hedstrom et al. | |

* cited by examiner

FORK-MOUNTED FORK TRUCK BOOM APPARATUS

CROSS-REFERENCE TO RELATED APPLICATION

This application claims benefit under 35 USC §119(e) of provisional application Ser. No. 61/640,124, filed Apr. 30, 2012, entitled FORK TRUCK BOOM APPARATUS the entire contents of which are incorporated herein by reference.

BACKGROUND

The present invention relates to a detachable boom for fork trucks that is releasably attached but further that is safely retained thereto without dependence on a safety chain.

Existing boom accessories for fork trucks include a frame adapted to engage the forks of a fork truck, and a boom extending from the frame. When lifted, the forks lift the frame and in turn lift the boom and any object hanging on an end of the boom. Sometimes during use and/or due to an incline of the forks or of the fork truck itself, the forks will be angled slightly downward. In such case, the boom accessory (and any object carried thereon) will tend to slide forward off the end of the forks (tines). As a result, a safety chain is used that is hooked between the accessory frame and the fork truck's carriage to prevent the accessory frame from accidentally sliding forward off the tines. However, safety chains have been known to be accidentally shaken off or disengaged (or are not properly installed), resulting in a risk to the boom accessory and the carried object can (and sometimes will) come off. This results in damage to the object being moved and, in some circumstances, can cause injury. A more positive retention mechanism is desired that is less sensitive to operator error and less sensitive to being shaken loose or accidentally dislodged.

SUMMARY OF THE PRESENT INVENTION

In one aspect of the present invention, a boom accessory for a fork truck including a carriage and lifting forks, comprises a frame having receiver tubes for receiving the forks, a boom attached to the frame and extending forwardly, and a frame-to-carriage anchor assembly on the frame. The frame-to-carriage anchor assembly includes a carriage-attaching subassembly with top and bottom connectors for securely engaging mating structure on the fork truck's carriage, and includes a vertically-slidable anchor between the carriage-attaching subassembly and the frame to restrain the frame horizontally from sliding forwardly off the forks but that permits vertical movement of the frame relative to the carriage-attaching subassembly. By this arrangement, the forks can lift a weight of the frame, boom, and boom-carried load without stressing the anchor assembly, but can prevent the frame from sliding forward off the forks.

These and other aspects, objects, and features of the present invention will be understood and appreciated by those skilled in the art upon studying the following specification, claims, and appended drawings.

BRIEF DESCRIPTION OF DRAWINGS

FIG. 8 is a side view but shown slightly in perspective.

DETAILED DESCRIPTION OF PREFERRED EMBODIMENTS

Figure 6:
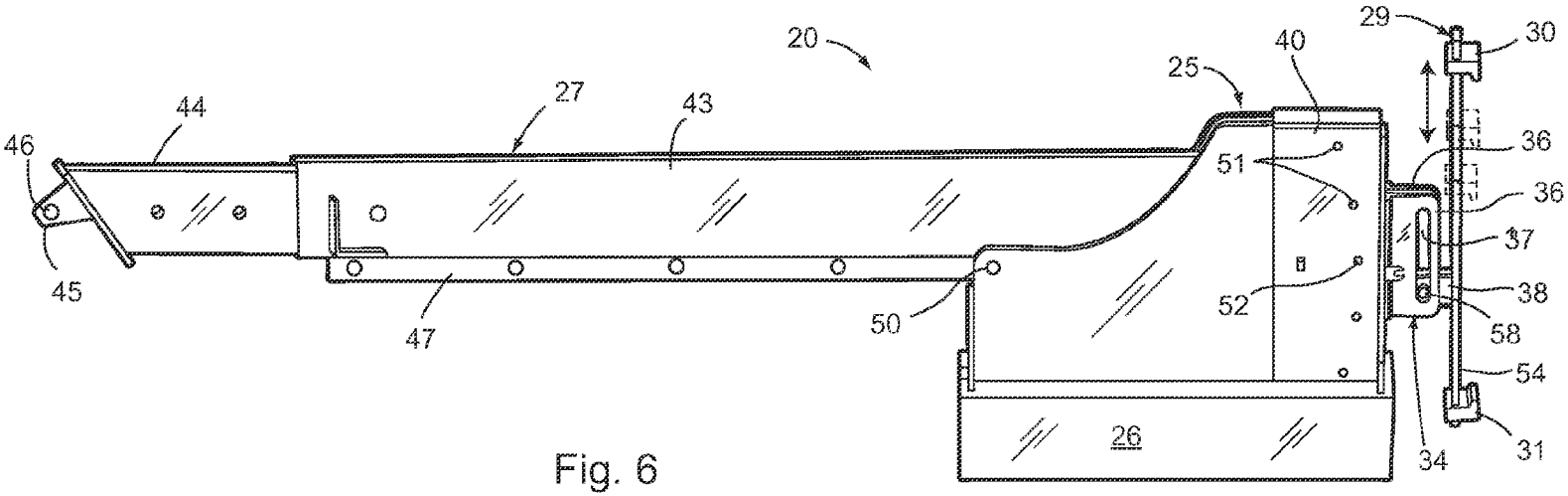
FIGS. 6, 6A, 7, 7A, and 8 are side views of the boom accessory of FIG. 1, FIGS. 6 and 6A being identical but FIG. 6A showing portions of a fork truck's carriage, FIGS. 7 and 7A being identical but of front and rear sides and with the boom at an angled position.
Figure 6A:
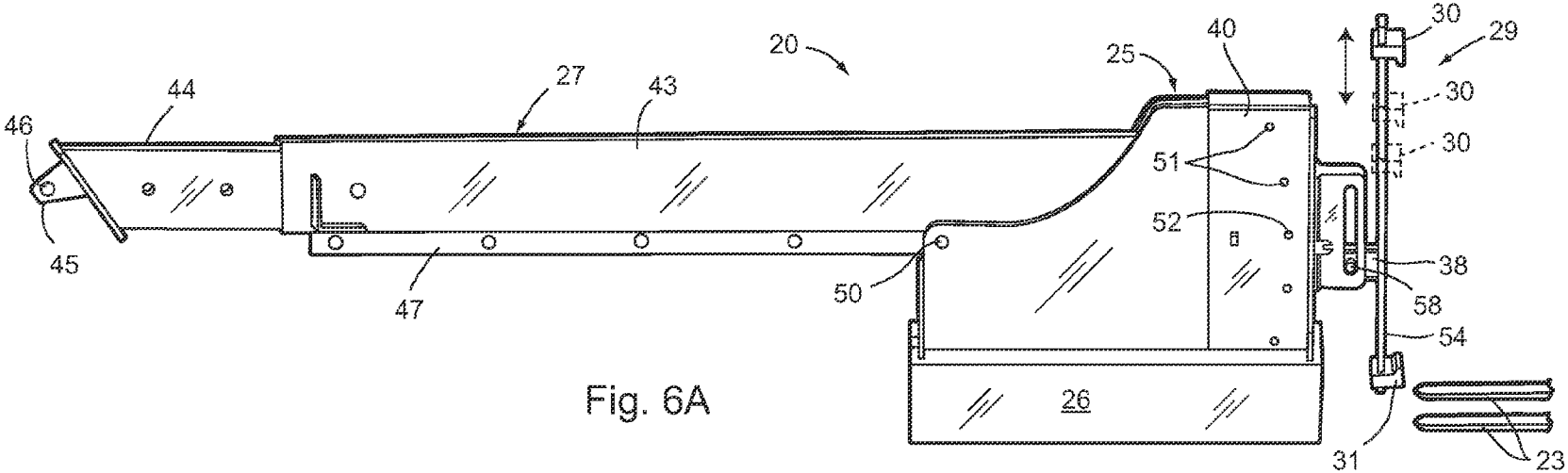
Figure 7:
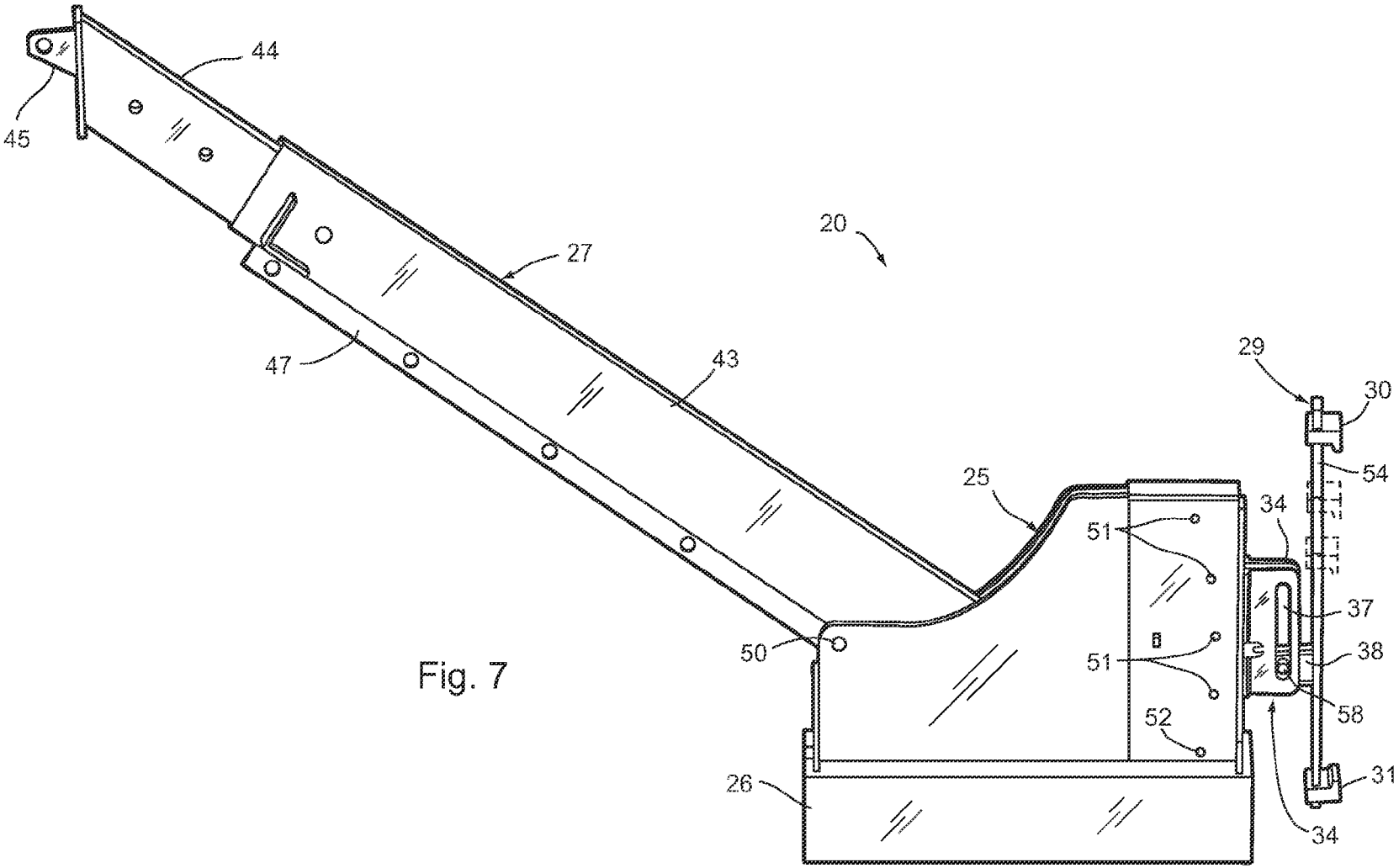
Figure 7A:
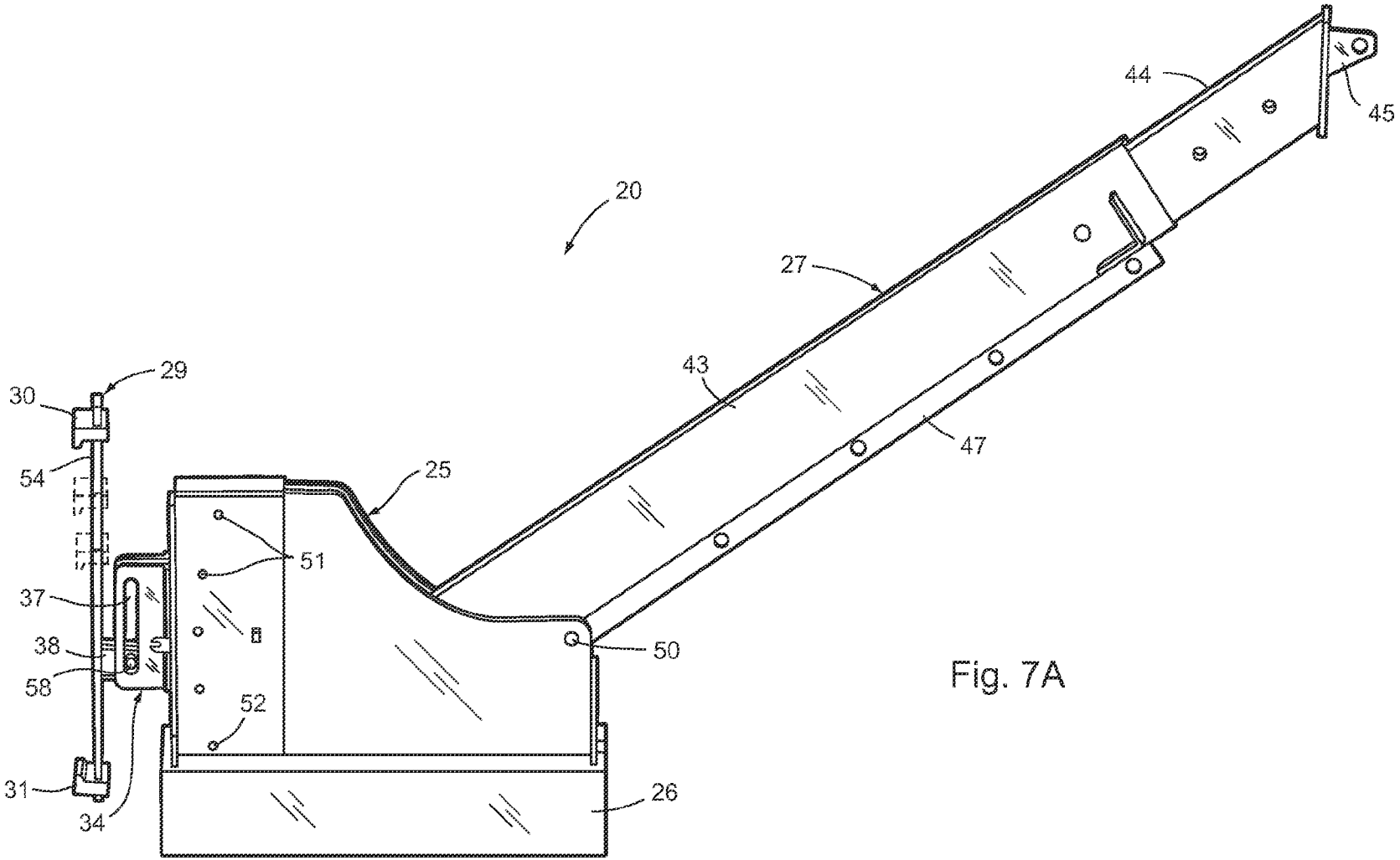
Figure 8:
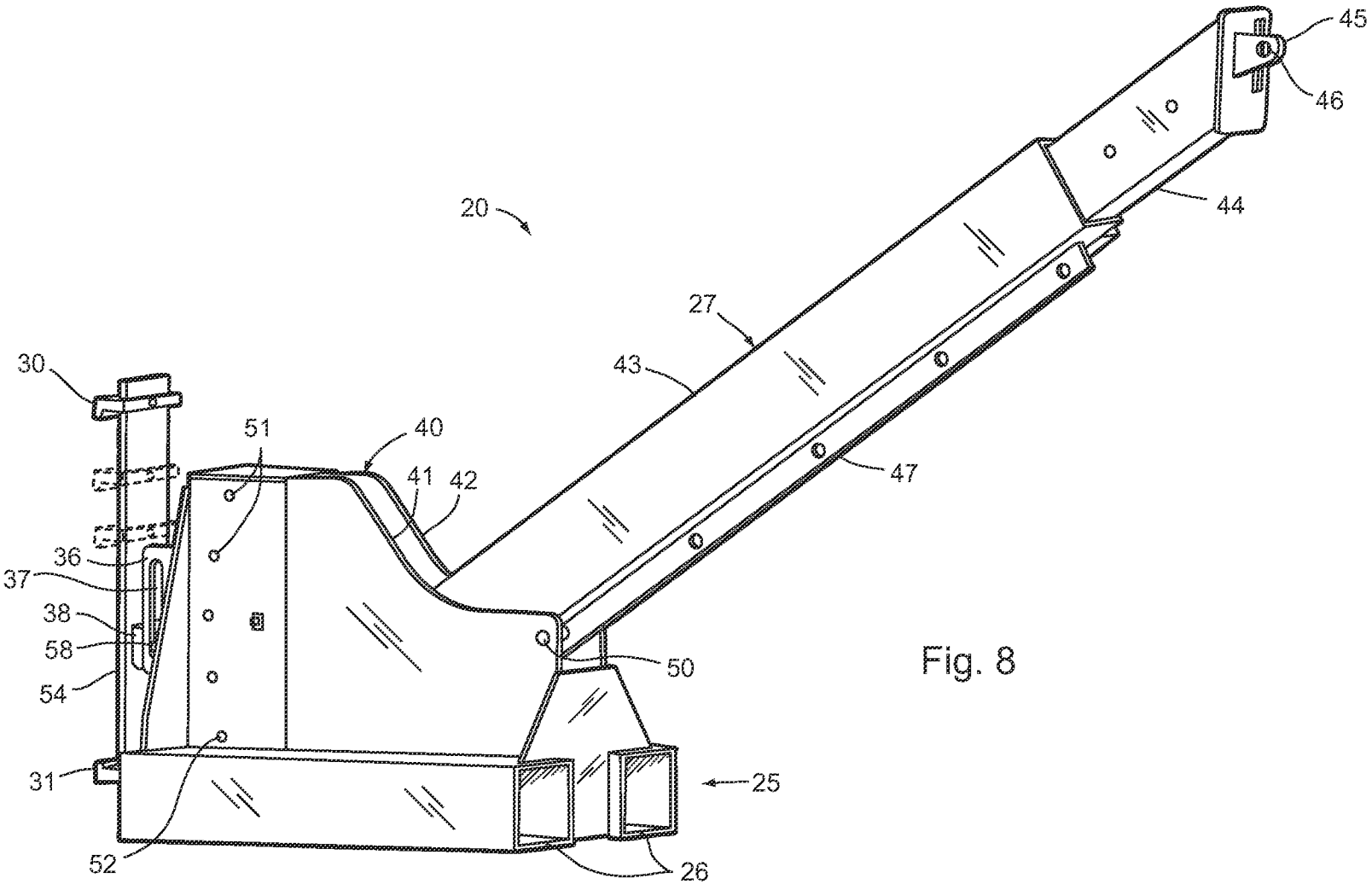

The present apparatus includes a boom accessory 20 (FIGS. 1, and 4-8) for releasable attachment to a fork truck 21, where the fork truck 21 includes an elevator carriage 22 with fork-carrying cross bars 22A and 22B, and L-shaped lifting forks 23. The boom accessory 20 includes a frame 25 having pair of receiver tubes 26 for receiving the forks 23, an extendable boom 27 attached to the frame 25 and extending forwardly, and a frame-to-carriage anchor assembly 28 on the frame 25. The frame-to-carriage anchor assembly 28 includes a carriage-attaching subassembly 29 with vertical plate 54 carrying top and bottom hook-shaped connectors 30 and 31 for securely engaging mating structure (bars 22A and 22B) on the fork truck's carriage 22. A vertically-slidable anchor 34 is located between and interconnects the carriage-attaching subassembly 29 and the frame 25 to restrain the frame 25 horizontally from sliding forwardly off the forks 23. Notably, the anchor 34 permits vertical movement between the subassembly 29 and the frame 25. Specifically, the anchor 34 (FIG. 6) includes horizontally-spaced vertical plates 36 supported by braces on the frame 25 with a vertical guide slot 37 formed by aligned vertical slots. A guide follower includes a block 38 that slides between the plates 36 and includes a horizontal guide pin 58 with ends engaging the vertical guide slot 37 in the plates 36. By this arrangement, the forks 23 can lift a weight of the boom accessory 20 (including the frame 25, boom 27, and any boom-carried load) without stressing the anchor assembly 28, but the anchor 34 prevents the boom accessory (including the frame 25 and boom 27) from sliding forward off the forks 23.

The frame 25 (FIG. 8) includes two receiver tubes 26 mounted under a boom-carrying box subframe 40. The box subframe 40 includes various plates and gussets welded together to form a ridge on the tubes 26, and includes a pair of upright plates 41 and 42 forming a space for the tail end of the boom 27. The boom 27 includes a primary boom beam 43, and a telescopingly extendable boom beam 44 with an end attachment bracket 45. The illustrated bracket 45 includes a protrusion with aperture 46 for receiving a bolt or other attachment, such as a boom hook carrying an object to be lifted. Also, aperture flange 47 provides additional attachment sites for carrying loads on the boom 27. A tail section of the boom 27 (not specifically shown, but similar in shape and structure of illustrated sections of the boom 27) extends to a rear area between upright plates 41 and 42. The upright plates 41 and 42 include a boom pivot 50 and further include a series of angle-fixing anchoring holes 51 spaced rearwardly and arcuately around the boom pivot 50. The boom 27 is pivoted on a pivot pin extended through the boom pivot 50, and is anchored in a selected angular position by an angle-fixing lock pin 52 extended through a selected one of the anchoring holes 51. (Compare FIGS. 1 and 8.)

Figure 1:
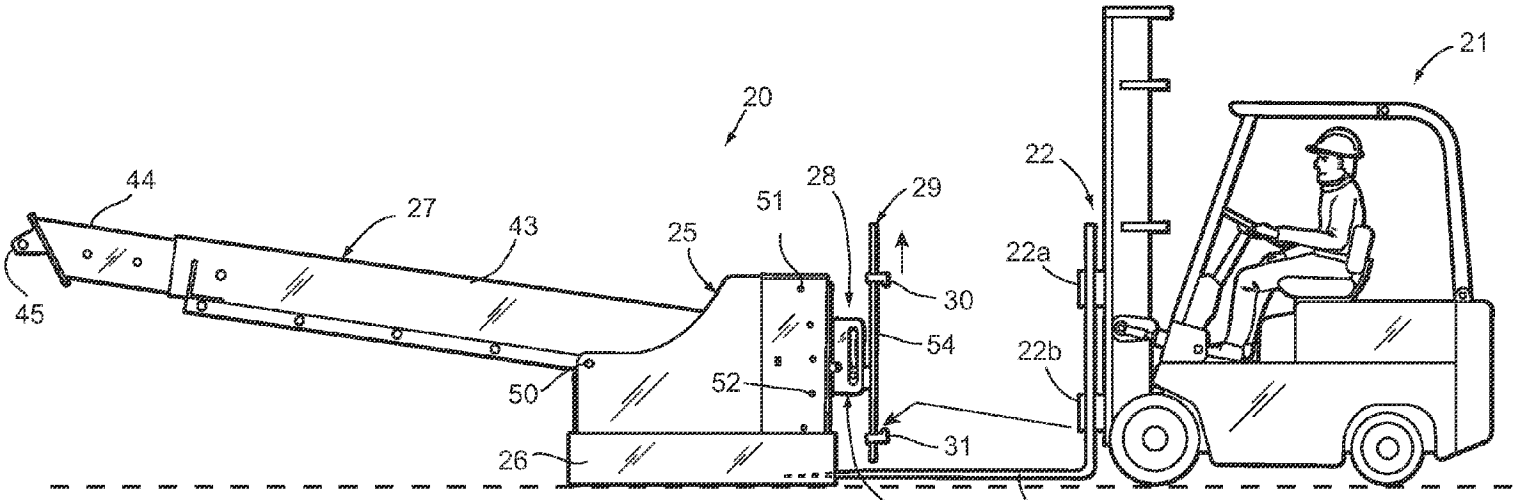
FIG. 1 is a side view of a fork truck ready to engage a boom accessory.
Figure 3:
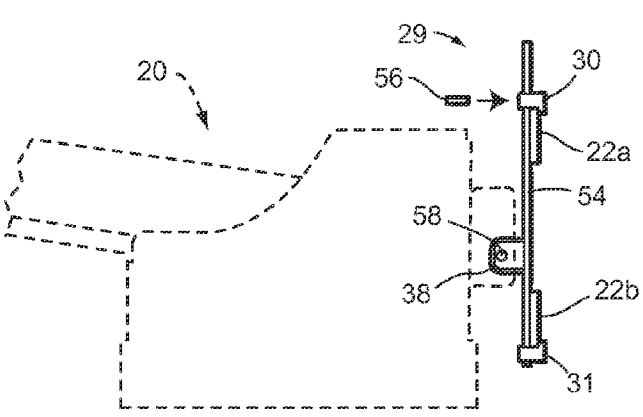
FIGS. 2-3 are side views of the anchoring brackets for engaging mating structure on the fork truck's carriage, FIG. 2 showing the carriage abutting the bottom connector and the anchor but not yet attached to the top connector, and FIG. 3 showing the top connector attached to the carriage.
Figure 2:
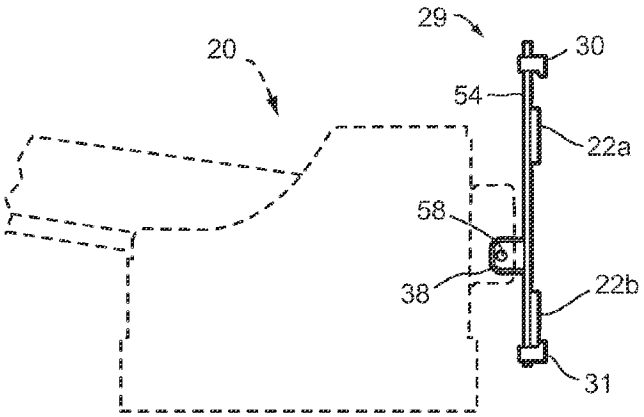
Figure 4:
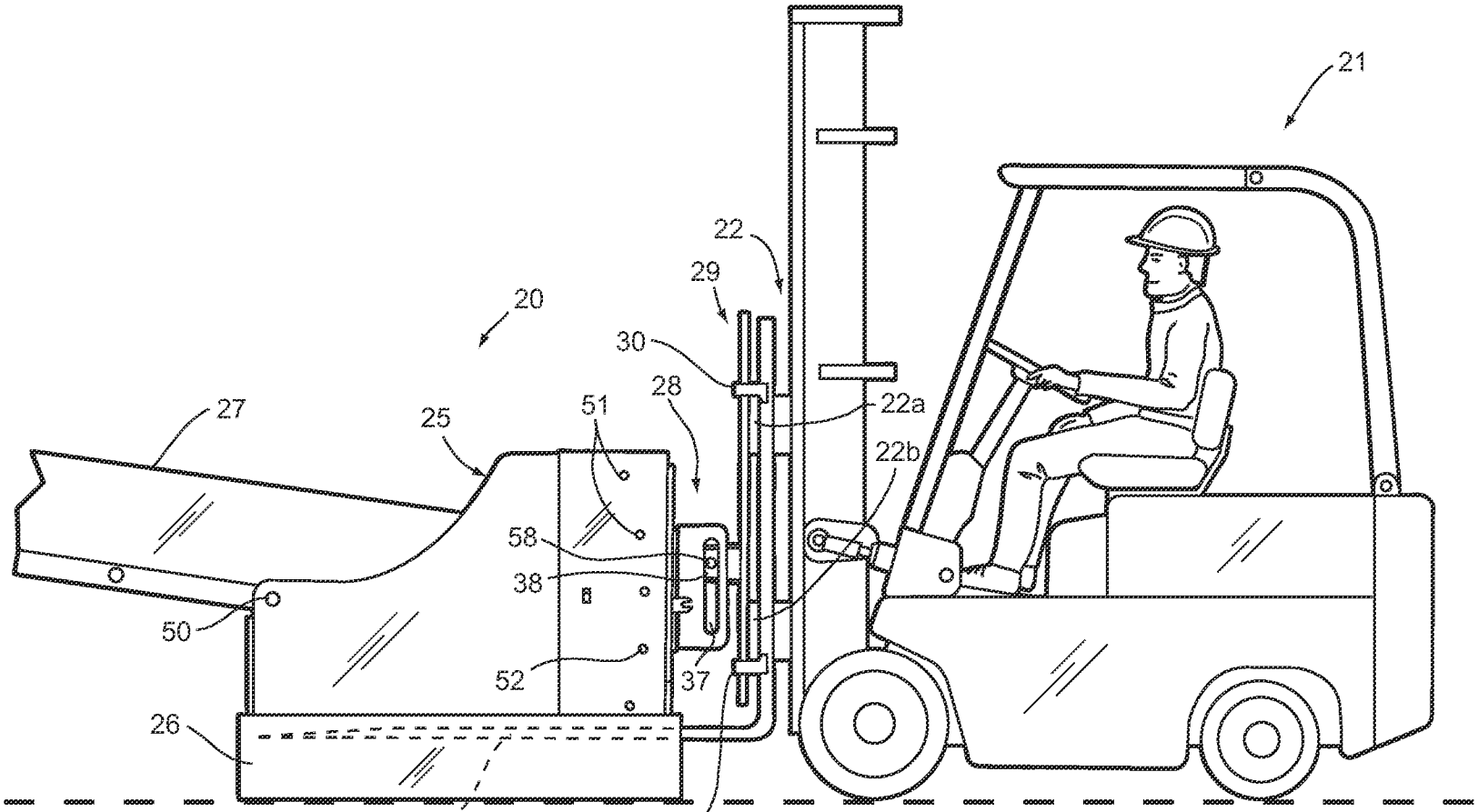
FIG. 4 is a side view similar to FIG. 1 but with the boom accessory attached and the forks lifted to support weight.
Figure 5C:
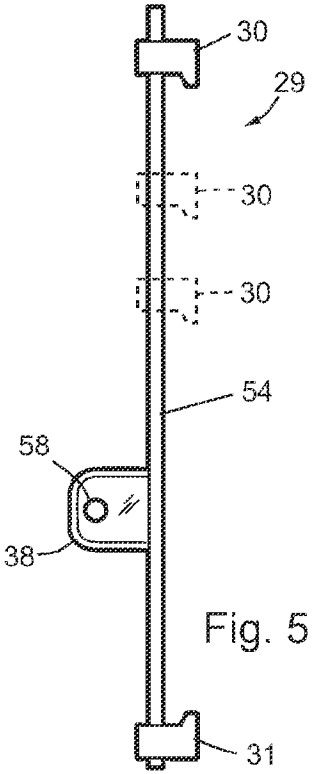
FIGS. 5A-5C are front, top, and side views of same.
Figure 5B:
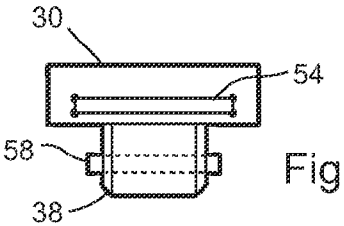
Figure 5A:
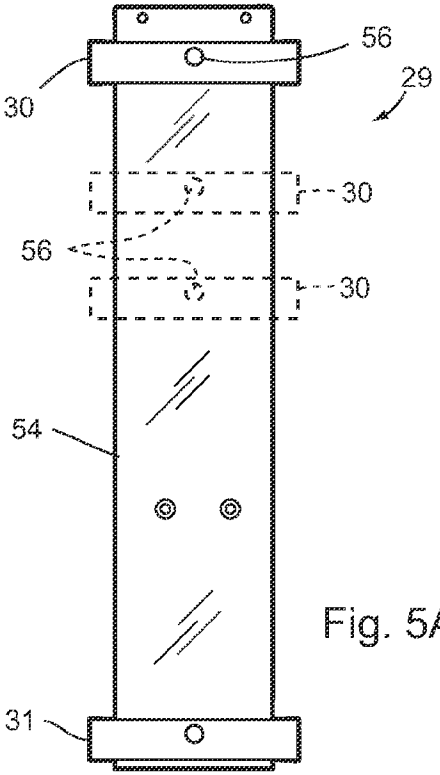
Figure 5:
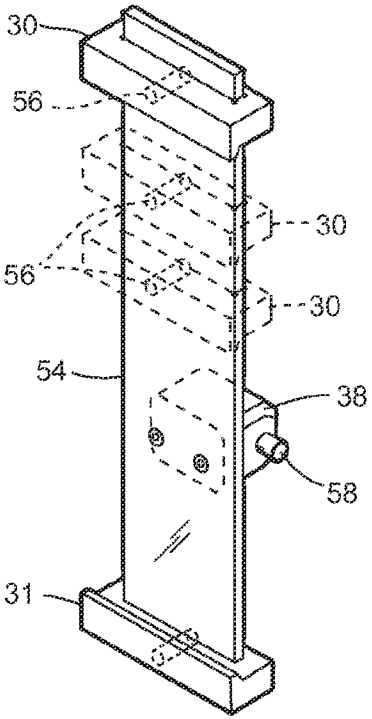
FIG. 5 is an exploded view of the carriage-attaching subassembly.

The frame-to-carriage anchor assembly 28 (FIGS. 2-3, and 5) includes a carriage-attaching subassembly 29 having a vertical plate post 54. The bottom hook connector 31 is fixed on a bottom of the post 54 and faces upwardly so that it is oriented to engage the bottom portion of the mating structure on the fork truck's carriage 22. The top hook connector 30 is vertically adjustably mounted on the post 54, and is moveable between standardized positions (see the three illustrated positions shown in FIGS. 6-8, but note that only one top connector 30 exists as shown). It is locked in place by a retainer pin 56 so that the top connector 30 cannot unexpectedly move vertically and release from the fork truck's carriage 22.

As noted above, the anchor 34 (FIG. 6) includes vertical plates 36 on the frame 25 with a vertical guide 37 formed by a vertical slot, and a guide follower block 38 with a transverse guide pin 58 slidably engaging the vertical guide slot 37. The arrangement allows the anchor 34 to provide a significant holding force to be transmitted from the mating structure on the carriage 22 through the connectors 30, 31 and the post 54, through the guide 37 and guide follower 38, to the boom-supporting box subframe 40. This arrangement is very secure, and if properly attached, is very unlikely to accidentally or unexpectedly release. Thus, the boom accessory 20 and any object carried thereon are securely held on the forks 23.

By this arrangement, the forks 23 can lift a weight of the boom accessory 20 (including the frame 25, boom 27, and any boom-carried load) without undesirably stressing the anchor assembly 28, but it positively and effectively prevents the boom accessory (including the frame 25 and boom 27) from accidentally sliding forward off the forks 23.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A boom accessory for a fork truck including a carriage and lifting forks, comprising:

a frame having receiver tubes for receiving the forks;

a boom attached to the frame and extending forwardly; and a frame-to-carriage anchor assembly on the frame that includes a carriage-attaching subassembly with top and bottom connectors for securely engaging mating structure on the fork truck's carriage and that includes a vertically-slidable anchor between the carriage-attaching subassembly and the frame to restrain the frame from sliding horizontally forward off the forks.

2. The accessory of claim 1, wherein one of the top and bottom connectors is vertically adjustable to clampingly engage top and bottom edges of fork-carrying members on the carriage.

3. The accessory of claim 2, wherein the top connector is vertically adjustable, and is adjustable between at least three different positions.

4. The accessory of claim 3, wherein the top connector is a hook-shaped connector that engages vertically and that is held in a hooked retaining position after engagement.

5. The accessory of claim 1, wherein the anchor includes a vertical guide and a mating guide follower engaging the guide to permit the vertical movement.

6. The accessory of claim 1, wherein the boom is pivoted to the frame, and wherein the frame includes multiple sites for receiving a locking pin to retain the boom in a selected angled position.

7. A boom accessory for a fork truck including a carriage with fork-carrying cross bars and forks carried on the cross bars, comprising:

a boom frame with a boom extending forwardly and with fork-engaging tubes; and an anchor assembly including a vertical plate, top and bottom connectors on the plate for securely engaging the cross bars on the fork truck's carriage, and a vertically-slidable anchor, the anchor assembly being configured to connect the boom frame to the cross bars to prevent the boom frame from sliding forward off the forks.

8. A method comprising:

providing a fork truck including a carriage with fork-carrying cross bars and forks carried on the cross bars;

providing a boom accessory for the fork truck, the boom accessory including a boom frame with a boom extending forwardly and with fork-engaging tubes, and including an anchor assembly including a vertical plate, top and bottom connectors on the plate for securely engaging the cross bars on the fork truck's carriage, and a vertically-slidable anchor, the anchor assembly being configure to connect the boom frame to the cross bars to prevent the boom frame from sliding forward off the forks;

motivating the fork truck to extend the forks into the fork-engaging tubes;

connecting the top and bottom connectors to secure the boom accessory to the cross bars of the fork truck;

connecting the anchor to one of the cross bars to secure the boom accessory to the fork truck and to prevent the boom accessory from accidentally sliding forwardly off the forks.

* * * * *